US009848668B2

(12) United States Patent
Smith, III

(10) Patent No.: US 9,848,668 B2
(45) Date of Patent: Dec. 26, 2017

(54) FOOTWEAR, FOOTWEAR COMPONENTS, AND METHODS OF MAKING AND USING SAME

(76) Inventor: Roy R. Smith, III, Sugar Land, TX (US)

( * ) Notice: Subject to any disclaimer, the term of this patent is extended or adjusted under 35 U.S.C. 154(b) by 1156 days.

(21) Appl. No.: 12/350,950

(22) Filed: Jan. 8, 2009

(65) Prior Publication Data

US 2010/0170115 A1 Jul. 8, 2010

(51) Int. Cl.

| | |
|---|---|
| ***A43B 23/00*** | (2006.01) |
| ***A43B 3/12*** | (2006.01) |
| ***A43B 3/00*** | (2006.01) |
| ***A43B 1/00*** | (2006.01) |
| ***A43B 23/24*** | (2006.01) |

(52) U.S. Cl.

CPC ..... *A43B 3/001* (2013.01); *A43B 1/0027* (2013.01); *A43B 3/0005* (2013.01); *A43B 3/0078* (2013.01); *A43B 23/24* (2013.01)

(58) Field of Classification Search

CPC ..... A43B 3/001; A43B 3/102; A43B 1/0072
USPC ..... 36/137; 362/103
See application file for complete search history.

(56) References Cited

U.S. PATENT DOCUMENTS

| | | | | |
|---|---|---|---|---|
| 4,020,572 | A * | 5/1977 | Chiaramonte, Jr. | 36/137 |
| 4,130,951 | A * | 12/1978 | Powell | 36/137 |
| 5,052,131 | A * | 10/1991 | Rondini | 36/137 |
| 5,502,903 | A * | 4/1996 | Barker | 36/137 |
| 5,604,999 | A * | 2/1997 | Barker | 36/137 |
| 5,664,346 | A * | 9/1997 | Barker | 36/137 |
| 5,720,121 | A * | 2/1998 | Barker | 36/137 |
| 5,813,148 | A * | 9/1998 | Guerra | 36/137 |
| 5,879,069 | A * | 3/1999 | Chien | 362/103 |
| 6,030,089 | A * | 2/2000 | Parker et al. | 362/103 |
| 6,976,762 | B2 * | 12/2005 | Chien | 362/84 |
| 7,607,243 | B2 * | 10/2009 | Berner et al. | 36/136 |
| 2003/0145494 | A1 * | 8/2003 | Hsu | 36/137 |
| 2005/0018450 | A1 * | 1/2005 | Chien | 362/565 |
| 2006/0053663 | A1 * | 3/2006 | Mao | 36/137 |
| 2007/0028486 | A1 * | 2/2007 | Montanya et al. | 36/137 |

* cited by examiner

*Primary Examiner* — Ted Kavanaugh
(74) *Attorney, Agent, or Firm* — Gilbreth Roebuck, PC; J.M. (Mark) Gilbreth

(57) ABSTRACT

Lighted footwear having a sole member; an illumination system positioned in the sole; and, an upper member providing an illumination path for receiving the light from the illumination system to illuminate at least a first portion of the upper.

5 Claims, 1 Drawing Sheet

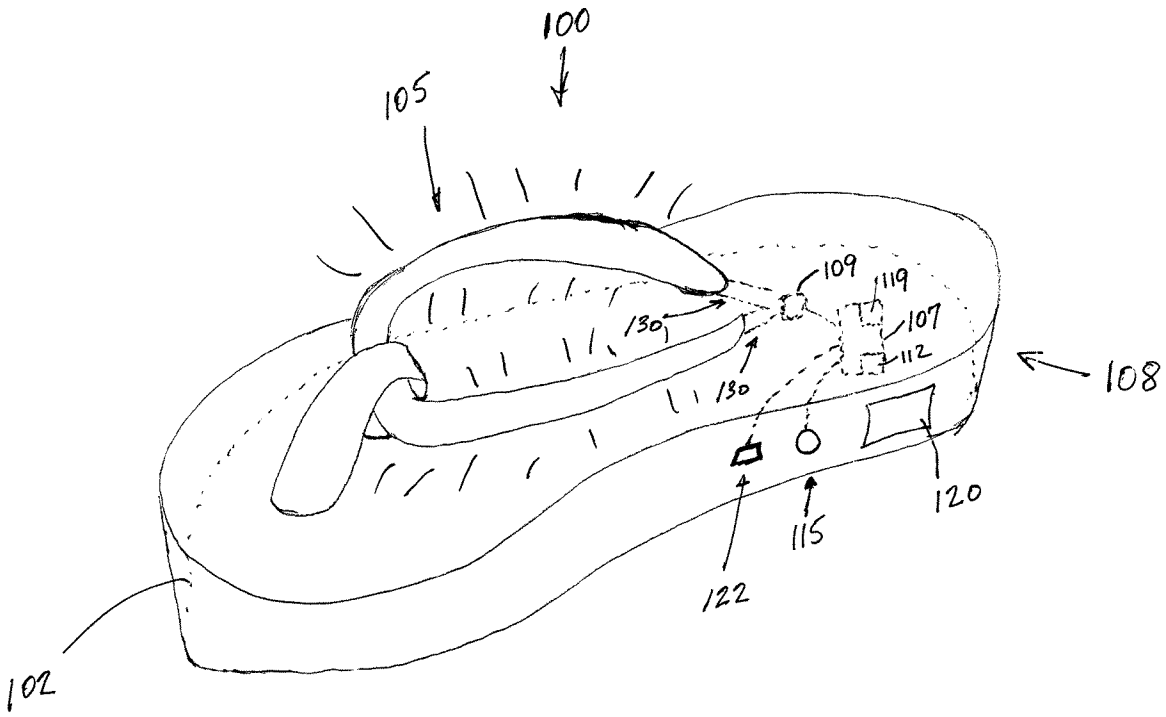
108
100
105
130
109
119
107
112
130
120
115
122
102

FOOTWEAR, FOOTWEAR COMPONENTS, AND METHODS OF MAKING AND USING SAME

RELATED APPLICATION DATA

None.

BACKGROUND OF THE INVENTION

1. Field of the Invention

The present invention relates to footwear, footwear components, and to methods of making and using same. In another aspect, the present invention relates to illuminated footwear, to footwear components, and to methods of making and using same.

2. Brief Description of the Related Art

It has long been known in the field of footwear to incorporate lighting devices, usually electrical in nature, into shoes, boots, sandals and the like for various reasons, e.g., to permit the wearer to see or be seen in reduced light situations, or to provide special effects during certain entertainment events.

A simple implementation of this type of footwear typically includes a light source, e.g., an incandescent bulb, a neon tube, or a light emitting diode ("LED"), a portable power supply, such as a battery, a manually operated on-off switch, and an electrical circuit connecting the three in series, all located in the footwear, typically within the sole and/or heel structures.

More complex lighted footwear efforts have been directed to switching the lighting circuit on and off in association with the presence or absence of the wearer's foot in the shoe, or by the contact of the wearer's foot with the ground, e.g., during walking or running. For example, the lighting circuit is switched on when the wearer's foot is inserted into the shoe. As another example, shoes may also includes means for automatically deactivating the lighting circuit under conditions of high ambient light. As even another example, footwear may contain lighting circuits activated by a switch disposed in the sole of the shoe and actuated by pressure exerted on it by the underside of the wearer's foot in contacting the ground. A more elaborate example involves a pneumatically actuated switch. As still another example, footwear may contain lighting circuits activated by a switch disposed in the sole of the shoe and actuated by pressure exerted on it by the ground when the shoe contacts the ground. As yet another example, footwear may contain lighting circuits activated by the angular position of the footwear.

Certainly, there are a number of patents disclosing footwear with lighting, the following of which are merely a few examples.

U.S. Pat. No. 4,130,951 to Powell issued Dec. 26, 1978, discloses illuminated dancing shoes in which the heel is made of hollow plastic and contains a battery powered flashlight for illuminating a compartment therein, having light transmitting holes in a side wall, covered with a translucent name label; and a light port at the front of the heel for energizing a bundle of light carrying optical fibers, extending through and embedded in the sole via branches that end in small light emitting faces spaced around the edge of the sole; and a manual switch in the front wall of the heel for enabling an energizing circuit for the flashlight, containing a spring opened pressure switch having a switch contactroller, the rim of which normally is slightly below the bottom of the heel, but closes the pressure switch when the shoe is stood on by the wearer, energizing the flashlight with each tap, and producing a series of flashes from the sole.

U.S. Pat. No. 5,052,131 to Rondini, issued Oct. 1, 1991, discloses strapped footwear with decorative lighting having a combination strap and decorative lighting fully encased in transparent tubing providing multifunctional footwear suitable for a variety of occasions including leisure and night clubs having a battery, lights encased in a transparent tubing connecting to a battery timed switch for flashing the lights and battery compartment located in the sole of the sandal in a compartment which is closed by a fastener and means for opening and closing the circuit. The combination pliable strap for fixing the foot to the footwear and decorative lighting cover can be employed in a variety of configurations to construct a wide diversity of footwear constructed in accordance with the invention.

U.S. Pat. No. 5,149,489 to Crews, issued Sep. 22, 1992, discloses illuminated ski boots and poles. The inventive ski boots include two layers of material for added warmth as well as a plurality of illuminated regions. Each illuminated region includes a lens which is elongated and which may be colored. Within each lens, an optical fiber is disposed. All of the optical fibers are exposed to light from a light source contained in each boot so that all of the lenses are illuminated when a switch is activated. The inventive ski poles have a transparent housing with a handle containing batteries and a light and with an optical fiber extending through the transparent portion to be illuminated by the light within the handle.

U.S. Pat. No. 5,303,485 to Goldston et al., issued Apr. 19, 1994, discloses footwear with flashing lights adapted to enhance the visibility of the wearer contains a light source, a power source, circuitry to connect the power source to the light source, and a pressure switch disposed in the sole of the footwear between the wearer's foot and the ground and adapted to turn the light source off when the wearer's foot is on the ground, and hence static, thereby conserving the power source, and to switch the light source on when the wearer's foot is off the ground, and usually moving, thereby providing enhanced visibility of the footwear and its wearer.

U.S. Pat. No. 5,430,621 to Raskas, issued Jul. 4, 1995, discloses an illuminatible shoelace device which comprises a section of flexible material having a cavity within the section and the section having a pair of ends, a fiber optic section is positioned within the cavity with a light source coupled to an end of the fiber optic section, a power supply is provided to power the light source, and switching circuitry, associated with the light source and the power supply, switches the light source on and off for transmitting light through the fiber optic section with the transmitted light illuminating the fiber optic section and the section of flexible material.

U.S. Pat. No. 5,461,188 to Drago et al., issued Oct. 24, 1995, discloses a synthesized music, sound and light system that is incorporated into articles of clothing such as a pair of shoes. The system when activated, allows a multiplicity of lights to illuminate in synchrony with the rhythmic beat of either an internal or an external music or sound program that is heard through an audio transducer. When the system is incorporated into a pair of shoes, a person can perform a dance routine or other form of expression in compliment with the selected music and light program. To enhance the utility of the invention, the system includes three user operated controls: a music program select switch that allows the selection of musical light programs, a control that allows the speed of the lights and rhythmic beat of the selected program to be increased or decreased, and a control that allows setting the volume of the sound.

U.S. Pat. No. 5,500,635 to Mott, issued Mar. 19, 1996, discloses products incorporating piezoelectric material, in particular a shoe, apparel, a ball or a fishing lure, incorporating an impact-sensing element made from polymeric piezoelectric material. In response to impact, the piezoelectric material generates an electrical signal to a battery-powered light- or sound-emitting unit or to an information display device which is at least partially molded into or contained in the product, thus causing circuitry to energize the light- or sound-emitting device from the battery or to display information on the information display device. In some embodiments involving light-emitting devices such as LEDs, the light is conducted to an outside surface of the product directly through the LED or via one or more optical fibers. A shoe can be provided with numerous light-emitting devices, one or more impact sensing elements, a temperature sensor and appropriate circuitry to process the impact and temperature information. This information is then used to light appropriate light-emitting devices such as to display a bar graph of temperature or force of impact, to light or flash individual light-emitting devices or to activate an information display device. In addition, a microprocessor can be included in the circuitry to provide preprogrammed control of the light emitting devices or to evaluate the input from the impact sensing element and then light the appropriate light emitting device or devices or to control the information displayed on the information display device.

U.S. Pat. No. 5,502,903 issued Feb. 25, 1997, U.S. Pat. No. 5,604,999 issued Apr. 2, 1996, and U.S. Pat. No. 5,720,121 issued Feb. 24, 1998, all to Barker, disclose footwear with illuminated linear optics having a power source, at least one light source operatively connected to the power source, a switching circuit for selectively illuminating the light source, and a linear side-glow optical conduit positioned exteriorly on the footwear so as to be visible when illuminated, the linear optical conduit having opposed end portions and being capable of emitting light conducted therethrough radially outwardly from its circumferential periphery substantially along its entire length, at least one end portion of the linear optical conduit being positioned and located in close proximity to the light source so as to receive light therefrom when illuminated, the linear optical conduit being illuminated substantially along its entire length when the light source is selectively illuminated. In the preferred embodiment, the linear optical conduit extends substantially around the outer exterior front and side portions of the footwear, although other arrangements are also disclosed herein. An interchangeable filter member may also be positioned between the light source and the one end portion of the linear optical conduit positioned in close proximity thereto, the filter member determining the color of the light directed towards the linear optical conduit end portion. The main features of the present invention are also incorporated into a self-contained portable illumination unit which can be easily attached to and removed from a wide variety of footwear. All embodiments of the present invention are adaptable for use on and with a wide variety of different types and styles of footwear.

U.S. Pat. No. 5,552,971 to Madden, issued Sep. 3, 1996, discloses a light assembly for shoe skates that removably encircles the skate frame below the shoe and is held in place by elastic tension. A plurality of light sources are positioned along the sides of the skate frame and are powered by a self-contained electric power source. The light sources may be a pair of elongate electroluminescent light sources or a plurality of LED's.

U.S. Pat. No. 5,577,828 to Nadel et al., issued Nov. 26, 1996, discloses light illuminating assemblies for wearing apparel. The decorative assembly includes a soft, flexible panel member having an upper surface, a lower surface, and a peripheral edge surface. The flexible panel member is sufficiently flexible to conform to the curvature of the mounting surface by hand pressure alone and is substantially comprised of a transparent or a translucent material. The flexible panel member defines a cavity in communication with the peripheral edge surface, which cavity is dimensioned and arranged to receive at least one light emitting element. The lower surface of the panel member causes a decorative pattern of refractive grooves dimensioned and arranged to reflect light propagating through the panel member in a plane disposed between its upper and lower surfaces.

U.S. Pat. No. 5,664,346 to Barker, issued Sep. 9, 1997, discloses a self-contained portable illumination unit removably attachable to a wide variety of footwear having a body assembly capable of housing and securely holding a power source, a switching circuit for selectively illuminating the light source, and one end portion of a linear side-glow optical conduit capable of emitting light conducted therethrough radially outwardly from its circumferential periphery substantially along its entire surface area, the one end portion of the linear optical conduit being positioned and located in close proximity to the light source so as to receive light therefrom when illuminated. The body assembly further includes a removable cover member for providing access to the power source and a removably adjustable mounting clip for removably attaching the body assembly to the footwear. When attached to footwear, the linear optical conduit extends exteriorly thereof so as to be visible when illuminated, the linear optical conduit being illuminated substantially along its entire length when the light source is selectively illuminated.

U.S. Pat. No. 5,722,757 to Chien, issued Mar. 3, 1998, discloses an illumination arrangement for a soft object such as an article of wearing apparel utilizes a light emitting diode as a light source and an optical element coupled with the light emitting diode to enhance the visibility of the illumination arrangement by distributing light emitted by the diode uniformly over a length or surface area of the optical element. The optical element may for example form part of a lace assembly, strap, or decorative panel of a shoe, boot, or sandal.

U.S. Pat. No. 5,813,148 to Guerra, issued Sep. 29, 1998, discloses footwear with optical fiber illuminating display areas provides emphasis on illuminating certain features of the footwear, such as trademarks, logos, team sports, cartoon characters, and other artistic designs primarily for advertising, decoration and enhancing the visibility of the wearer. Footwear with optical fiber illuminating display areas includes: an optical fiber panel(s) made visible through an opening, window, or transparent material on the sole, upper, or tongue portions of the footwear; a light emitting device(s) which transmits light into the optical fiber panel(s); components and circuits for making the light emitting device(s) and the illuminating optical fiber display areas intermittently flash, alternate flash, alternate colors, sequence in motion, activate by pressure or motion switching, activate by manual switching, or any combination thereof; and batteries for supplying power to the light emitting device and the components and circuits aforementioned. A control module combines the light emitting device(s), components and circuits, and batteries into a housing which is positioned in the heel, sole, upper, or tongue portion of the footwear, depending on the embodiment employed. Such footwear embodiments include and are not limited to athletic shoes (e.g. Tennis, Basketball, aerobic, cross trainers, walking, jogging, running), casual and formal dress shoes, roller skates, Ice skates, and Ski boots.

U.S. Pat. No. 5,894,686 issued Apr. 20, 1999 and U.S. Pat. No. 6,030,089 issued Feb. 29, 2000, both to Parker et al., disclose light distribution systems that include a light emitting portion, a light source for supplying light to the light emitting portion and a power source for the light source. A sealed holder or pocket may be provided for the light emitting portion. The light emitting portion may be located on an upper portion of a shoe and include a raised or relieved area from which light is emitted. The light distribution systems may include an additional light source which is directional so it can be seen at a greater distance than the light emitting portion. An information display system may also be provided, including a liquid crystal display located on an upper portion of a shoe, and a motion sensor for controlling operation of the display.

U.S. Pat. No. 7,255,468 to Capriola, issued Aug. 14, 2007, discloses an apparatus for illuminating shoes and fashion accessories that includes a fiber optic cable, a clasp and a control circuit. The fiber optic cable has a first coupling point and a second coupling point. The clasp has a housing, a retention mechanism, a first connector and a second connector. The first connector is configured to couple to the first coupling point and the second connector is configured to couple to the second coupling point of the fiber optic cable. The control circuit is disposed within the housing and has a power source and at least one illuminating device. The illuminating device is optically coupled to one or both of the first and second connectors in order to illuminate at least a portion of the fiber optic cable with light. At least one of the clasp and the illuminating device is removable to permit interchangeable selectivity of the color of the illuminating light.

U.S. Pat. No. 7,347,577 to Rapisarda, issued Mar. 25, 2008, discloses a lighting system for clothing, footwear, backpacks, and other accessories that incorporates a battery, a switch, a counter circuit, a flasher and lamps or LEDs driven by the flasher. An improved switch has a tubular housing of electrical insulating material, which may be, for example, round or square in cross section. A pair of electrical contact pins extend into the interior of the housing and are aligned longitudinally. The external ends of the contact pins are wired to the counter circuit and the battery. A free-floating contact bar of electrical conducting material normally resides on the bottom of the housing and, upon movement of the shoe or clothing, will bounce against the contact pins thus closing the switch and causing an input signal to the counter circuit and causing the lamps or LEDs to be illuminated momentarily. In a second embodiment, the contact pins extend through the bottom of the housing and the contact bar may rest against the contact pins. An electrical timer circuit responsive to closing of the switch limits the flashing of the LEDs to one sequence of flashes until further movement of the switch causes it to open and close again.

SUMMARY OF THE INVENTION

According to one embodiment of the present invention, there is provided footwear comprising, a sole member; an original illumination system positioned in the sole member for providing light; and, an upper member comprising an illumination path for receiving the light from the illumination system to illuminate at least a first portion of the upper member, the path having a first end positioned to receive light from the illumination source and allowing the light to travel to and illuminate the first portion. According to further sub-embodiments of this embodiment, there is provided footwear having one or more of the following: the illumination path is a defined by the upper member as a gaseous portion contained within a hollow passage defined by the upper member; the illumination path comprises optical fibers; the illumination system is removably attached to the sole member; further comprising a replacement illumination system for interchanging with the original illumination system; wherein the illumination path further comprises translucent or transparent portions; wherein the illumination path further comprises translucent or transparent portions, which portions may be colored or tinted; wherein the illumination system comprises a processor for controlling the light from the illumination system; wherein the illumination system further comprises rechargeable batteries; wherein the illumination system further includes a communication member; and/or further comprising a switch; further comprising a port.

According to another embodiment of the present invention, there is provided a method of operating footwear, wherein the wherein the footwear may be as described herein. The method includes at least one of: removing the illumination system, exchanging the illumination system with another illumination system, accessing the illumination system, opening/closing the access panel to the illumination system, changing the batteries of the illumination system, charging the batteries of the illumination system, communicating with the illumination system, providing instructions to the illumination system, receiving instructions with the illumination system, changing the illumination source of the illumination system, operating the illumination system, operating the switch of the illumination system, sending and/or receiving wireless or connected communications to/with the illumination system, moving the footwear to operate the illumination system, moving the footwear by relating the movement to the light from the illumination system.

BRIEF DESCRIPTION OF THE DRAWINGS

The following drawings illustrate some of the many possible embodiments of this disclosure in order to provide a basic understanding of this disclosure. These drawings do not provide an extensive overview of all embodiments of this disclosure. These drawings are not intended to identify key or critical elements of the disclosure or to delineate or otherwise limit the scope of the claims. The following drawings merely present some concepts of the disclosure in a general form. Thus, for a detailed understanding of this disclosure, reference should be made to the following detailed description, taken in conjunction with the accompanying drawings, in which like elements have been given like numerals.

FIG. 1 is an illustration view of footwear 100 having a sole member 102 in which is disposed light system 108, and having an upper member 105.

DETAILED DESCRIPTION OF THE INVENTION

The present invention provides for footwear having an upper portion of the footwear that is internally illuminated by light transmitted from an internal light source disposed in the sole of the footwear. In some non-limiting embodiments, this light source may not be visible or detectable upon inspection. In some non-limiting embodiments, the light source may illuminate a portion, portions, or the entire upper of the footwear from within the sole of the footwear. In some non-limiting embodiments, light may travel from within the sole of the shoe through a passage in the sole of the shoe to the upper portion of the shoe and illuminate the upper portion of the shoe.

Referring now to FIG. 1, there is shown Footwear 100 having a sole member 102 in which is disposed light system 108, and having an upper member 105.

Sole member 102 may be any suitable type of sole member as is known in the footwear art. Certainly, sole member 102 may be of any desired material of construction as is known in to those of skill in the footwear art, and most likely will be influenced by the desired end usage and fashion of the footwear. Also certainly, the shape and construction of sole member 102 may be any as desired according to the desired end usage and fashion of the footwear.

In some non-limiting embodiments of the present invention, light system 108 may be disposed within sole member 102. While some parts or portions of light system 108 may be positioned throughout footwear 100, in some non-limiting embodiments, the light source is positioned within sole member 102. In some non-limiting embodiments, it is envisioned that sole member 102 defines a light system compartment suitable for receiving light system 108. In other non-limiting embodiments, where sole member 102 comprises a moldable material, it is anticipated that light system 108 may be incorporated into sole member 102 during the molding process. It is certainly anticipated that footwear 100 may be manufactured by any suitable process for making footwear.

In FIG. 1, box 107 is a schematic representation which may include one or more of a source of energy 112, a processor/electronics 119, ports 122, switches 115, wireless communication device, speaker, clock/timer, GPS, data gathering device (for gathering environmental data and/or performance data). In some embodiments, box 107 may comprise one or more cases for holding such batteries 112, processor/electronics 119, ports, switches and devices. Certainly, any component of schematic box 107 may be positioned throughout footwear 100 with or without any such case.

Light system 108 may be activated/controlled by any number of suitable means. In the non-limiting embodiment as shown, light system 108 may be provided with a switch 115 that may be positioned on the side of sole member 102 to be hand activated as shown. Of course, switch 115 may be located on any suitable position throughout footwear 100. As another non-limiting example, light system 108 may be adapted to receive instructions, as non-limiting examples, wireless signals or instructions from any suitable controller. These signals or instructions may include simple on/off instructions or may be instructions for simple or complex lighting patterns, or instructions for blinking out a certain running pace with the blinking setting a pace for which a foot should be hitting the ground. As another non-limiting example, light system 108 may be provided with a port or connector 122 to allow physical connection to any other device, as non-limiting examples, a device that will provide signals and/or instructions, or a device to download information from light system 108. As another non-limiting example, light system 108 may be provided with a switch that is in a position to be activated by activity (i.e., moving, walking, running, jumping, hoping skipping, dancing, etc.).

As another example, light system 108 may further comprise a sensor which will detect for example, light, heat, sound, odor, chemicals, particles, smoke, radiation, humidity, or any other as desired, and activate light system 108 as desired. As specific non-limiting examples, light system 108 may be made to pulse to a detected music beat, blink a warning for smoke, chemicals, radiation, and/or heat, or turn on in low light.

In the present invention, light system 108 may also include an illumination source 109. This illumination source 109 may be any suitable light producing means, including but not limited to traditional bulbs or LEDs. In some non-limiting embodiments of the present invention, this illumination source 109 is not visible or detectable upon inspection, that is, it is hidden within sole member 102.

Upper 105 will define an illumination path allowing for travel of light from light source 109 to travel through upper 105. As non-limiting examples, this illumination path may defined by upper 105 as a hollow passage allowing light to pass through the empty space within the passage, or may be optical fibers positioned within a passage of upper 105, or optical fibers incorporated into a solid portion of upper 105. In the non-limiting example as shown, the illumination path is the gaseous portion contained within hollow upper 105. In some embodiments, the illumination path is a solid path, such as when optical fibers are utilized.

Light is provided from light source 109 to upper 105 by travel from the sole member 102 into hollow upper member 105, rather than from a light source being positioned in upper member 105. In the non-limiting embodiment as shown, light from internal illumination source 109 travels though the space of passage 130 defined by sole member 102 and into hollow upper member 105 thereby illuminating hollow upper member 105. Passage 130 may be of any suitable size and shape. In some embodiments, this indirect manner provides a softer and more pleasing source of light. Were the light source visible in upper 105, a much more harsh direct light would be provided. Illumination source 109 may illuminate a portion, portions, or the entire upper of the footwear from within.

According to the present invention, light system 108 may include a power source 112 that provides power to light source 109. Non-limiting examples of suitable power sources include a non-replaceable battery, a replaceable battery, a rechargeable battery, solar panel, or a motion activated electrical generating source. The rechargeable batteries may be removed and recharged, or may be recharged insitu though a port such as port 122. Such batteries include common commercially available batteries, especially such small batteries as are found in watches.

Light system 108 may also include a processor/electronics 119 for controlling the light output. This processor/electronics 119 may comprise one or more of a simple circuit, a complex processor, or anything in between. This processor/electronics 119 may comprise preloaded instructions, or may be provided instructions either through wireless communication and/or through a port such as port 122.

If there is to be access to light system 108, for example to change power source 112 or light source 109, an access panel 120 may be provided. Such a panel may be designed to sufficiently seal light system 108 against any elements as desired. Light system 108 may be removable from footwear 100, as non-limiting examples, for replacement by another system, or for placement into different footwear. Light system 108 may be removably attached, that is, as non-limiting examples, it may be friction fit, snapped, connected, twisted, locked, screwed into place, and then later easily removed. This light system 108 may be a cartridge or modular unit, and may be easily replaced, or removed and then placed into different footwear. Any part of or all of light system 108 may be removable from footwear 100. The present invention anticipates one or more extra light systems 108 for replacement of light system 108 currently residing in footwear 100.

Light system 108 may optionally includes fiber optic strands positioned within upper 105 having one end positioned adjacent light source 109 for transmitting light to the upper 105.

In certain non-limiting embodiments of the present invention, fiber optic strands may be a conventional type manufactured flexible tubular plastic material that is capable of transmitting light that is emitted into one end of each of the strands. It is noted that typically, fiber optic strands transmit light from one end to the other end without any light escaping through the outer surface of the strand along the entire length of each strand, a process known as total internal reflection. In the some non-limiting embodiments of the present invention however, it is desired that at least a portion of the transmitted light escape laterally from the strand.

Generally, a fiber optic strand will consist of a core surrounded by a cladding layer that serves to confine the optical signal in the core. As a non-limiting examples, light may be allowed to escape from the fiber optic stand by modifying the cladding layer, either during manufacture or post manufacture. In some non-limiting embodiments of the present invention, this may be achieved by abrading the outer surfaces of fiber optic strands. This abrading allows light to escape through the exposed outer surfaces to allow the strands to have the appearance of glowing. As design options, some of the other strands have outer surfaces which have not been modified or abraded. Additionally, it is also possible to abrade a portion or portions of the length of each of the strands to provide certain light effects or to produce decorative designs. One non-limiting method of abrading the outer surfaces of fiber optic stands is to sand the outer surfaces.

In the practice of the present invention, upper 105 may comprise any suitable design. It is not intended that the present invention be limited to strap type uppers as shown in FIG. 1, but rather include any type of upper known or that might be designed. Upper 105 may be any suitable type of upper member as is known in the footwear art. Certainly, upper 105 may be made of any desired material of construction as is known in to those of skill in the footwear art. Also certainly, the shape and construction of upper member 105 may be any as desired according to the desired end usage of the footwear. Any suitable illumination passage may be defined by an upper of any desired shape and fashion.

At least a portion of the upper 105 will comprise a glowing portion that will provide a light travel path to allow light from light source 109 positioned in sole member 102 to illuminate at least a portion of upper 105. This may be accomplished by providing at least a portion of upper 105 that is transparent or translucent positioned suitable to receive light from light source 109.

In the non-limiting embodiment as shown, upper 105 comprise hollow straps defining a space serving as a light travel path. At least a portion of hollow straps 105 is translucent or transparent, and these straps may optionally be tinted to further provide variation and color combinations. These hollow straps 105 may be any suitable regular or irregular geometric cross sectional shape including circular, square, rectangular, oval, flat or some combination thereof.

The present invention also anticipates methods of using the footwear of the present invention, which methods may include one or more steps of removing the illumination system, exchanging the illumination system with another illumination system, accessing the illumination system, opening/closing the access panel to the illumination system, changing the batteries of the illumination system, charging the batteries of the illumination system, communicating with the illumination system, providing instructions to the illumination system, receiving instructions with the illumination system, changing the illumination source of the illumination system, operating the illumination system, operating the switch of the illumination system, sending and/or receiving wireless or connected communications to/with the illumination system, moving the footwear to operate the illumination system, and/or moving the footwear by relating the movement to the light from the illumination system, gathering data with the footwear, as well as any other methods and/or method steps as disclosed, shown or suggested herein.

The present disclosure is to be taken as illustrative rather than as limiting the scope or nature of the claims below. Numerous modifications and variations will become apparent to those skilled in the art after studying the disclosure, including use of equivalent functional and/or structural substitutes for elements described herein, use of equivalent functional couplings for couplings described herein, and/or use of equivalent functional actions for actions described herein. Any insubstantial variations are to be considered within the scope of the claims below.

The invention claimed is:

1. Footwear comprising:

A sole member;

An original illumination system positioned within the sole member for providing light to a translucent upper; and, A translucent strap type upper defining an internal illumination path passing internally through the upper for receiving the light from the illumination system to internally illuminate the entire upper of the footwear from within the sole of the footwear, the translucent upper positioned to receive light from the illumination system positioned within the sole and allowing the light to travel to and internally illuminate the entire upper of the footwear.

2. The footwear of claim 1, wherein the illumination path is a defined by the upper as a gaseous portion contained within a hollow passage defined by the upper.

3. Footwear comprising:

A sole member;

An original illumination system positioned in the sole member for providing light; and, A translucent upper comprising an illumination path internally within the upper for receiving the light from the illumination system to internally illuminate the entire upper, the path having a first end positioned to receive light from the illumination system and allowing the light to travel to and illuminate the entire upper.

4. The footwear of claim 3, wherein the illumination path is a defined by the upper as a gaseous portion contained within a hollow passage defined by the upper.

5. Footwear comprising:

A sole member;

An original illumination system positioned in the sole member for providing light; and, A translucent upper receiving the light from the illumination system to internally illuminate the entire translucent upper, the translucent upper having a first end positioned to receive light from the illumination system allowing the light to travel to and internally illuminate the entire translucent upper.

* * * * *